US008240259B2

(12) United States Patent
Fischer et al.

(10) Patent No.: US 8,240,259 B2
(45) Date of Patent: Aug. 14, 2012

(54) METHOD AND APPARATUS FOR COOLING HOT GASES AND FLUIDIZED SLAG IN ENTRAINED FLOW GASIFICATION

(75) Inventors: Norbert Fischer, Lichtenberg (DE); Dietmar Degenkolb, Freiberg (DE); Friedemann Mehlhose, Freiberg (DE); Manfred Schingnitz, Freiberg (DE)

(73) Assignee: Siemens Aktiengesellschaft, München (DE)

( * ) Notice: Subject to any disclaimer, the term of this patent is extended or adjusted under 35 U.S.C. 154(b) by 321 days.

(21) Appl. No.: 11/584,654

(22) Filed: Oct. 20, 2006

(65) Prior Publication Data

US 2008/0005966 A1 Jan. 10, 2008

(30) Foreign Application Priority Data

Jul. 7, 2006 (DE) ..... 10 2006 031 816

(51) Int. Cl.
*F23J 15/00* (2006.01)

(52) U.S. Cl. ..... 110/343; 110/215; 110/229; 110/345; 96/272; 96/273; 96/277; 96/322

(58) Field of Classification Search ..... 96/322, 96/326, 327, 270, 271, 272, 273, 277; 239/193; 11/215, 216, 229, 343, 345, 259; 110/215, 110/216, 229, 343, 345, 259
See application file for complete search history.

(56) References Cited

U.S. PATENT DOCUMENTS

| | | | | |
|---|---|---|---|---|
| 1,866,193 | A * | 7/1932 | Coutant | 96/272 |
| 3,585,786 | A * | 6/1971 | Hardison | 96/265 |
| 3,841,061 | A * | 10/1974 | Pike | 96/272 |
| 4,164,399 | A * | 8/1979 | Kannapell | 96/271 |
| 4,377,132 | A * | 3/1983 | Koog et al. | 122/7 R |
| 4,489,679 | A * | 12/1984 | Holt | 110/215 |
| 4,848,982 | A * | 7/1989 | Tolle et al. | 48/69 |
| 5,928,519 | A * | 7/1999 | Homan | 96/187 |
| 6,019,818 | A * | 2/2000 | Knapp | 96/273 |
| 6,250,236 | B1 * | 6/2001 | Feizollahi | 110/345 |
| 7,618,595 | B2 * | 11/2009 | Hartung et al. | 110/215 |

FOREIGN PATENT DOCUMENTS

| | | | |
|---|---|---|---|
| CN | 88101732 | A | 10/1988 |
| DE | 145025 | A3 | 11/1980 |
| DE | 35 34 015 | | 4/1986 |
| DE | 3534015 | A1 | 4/1986 |
| DE | 3711314 | A1 | 10/1988 |
| DE | 288614 | A5 | 4/1991 |
| DE | 197 18 131 | | 11/1998 |
| DE | 19718131 | A1 | 11/1998 |
| DE | 4309493 | C2 | 10/2002 |
| GB | 2 164 951 | | 4/1986 |

* cited by examiner

*Primary Examiner* — Kenneth Rinehart
*Assistant Examiner* — David J Laux
(74) *Attorney, Agent, or Firm* — Collard & Roe, P.C.

(57) ABSTRACT

A method and device for cooling hot crude gas and slag from entrained flow gasification of liquid and solid combustibles at crude gas temperatures ranging from 1,200 to 1,800° C. and at pressures of up to 80 bar in a cooling chamber disposed downstream of the gasification reactor by injecting water. The cooling water is distributed, with a first portion being finely dispersed into to cooling chamber and a second portion being fed at the bottom into an annular gap provided between the pressure-carrying tank wall and an incorporated metal apron for protecting said pressure-carrying tank wall. The second portion of the cooling water flows upward in the annular gap and trickles down the inner side of the metal apron in the form of a water film.

15 Claims, 1 Drawing Sheet

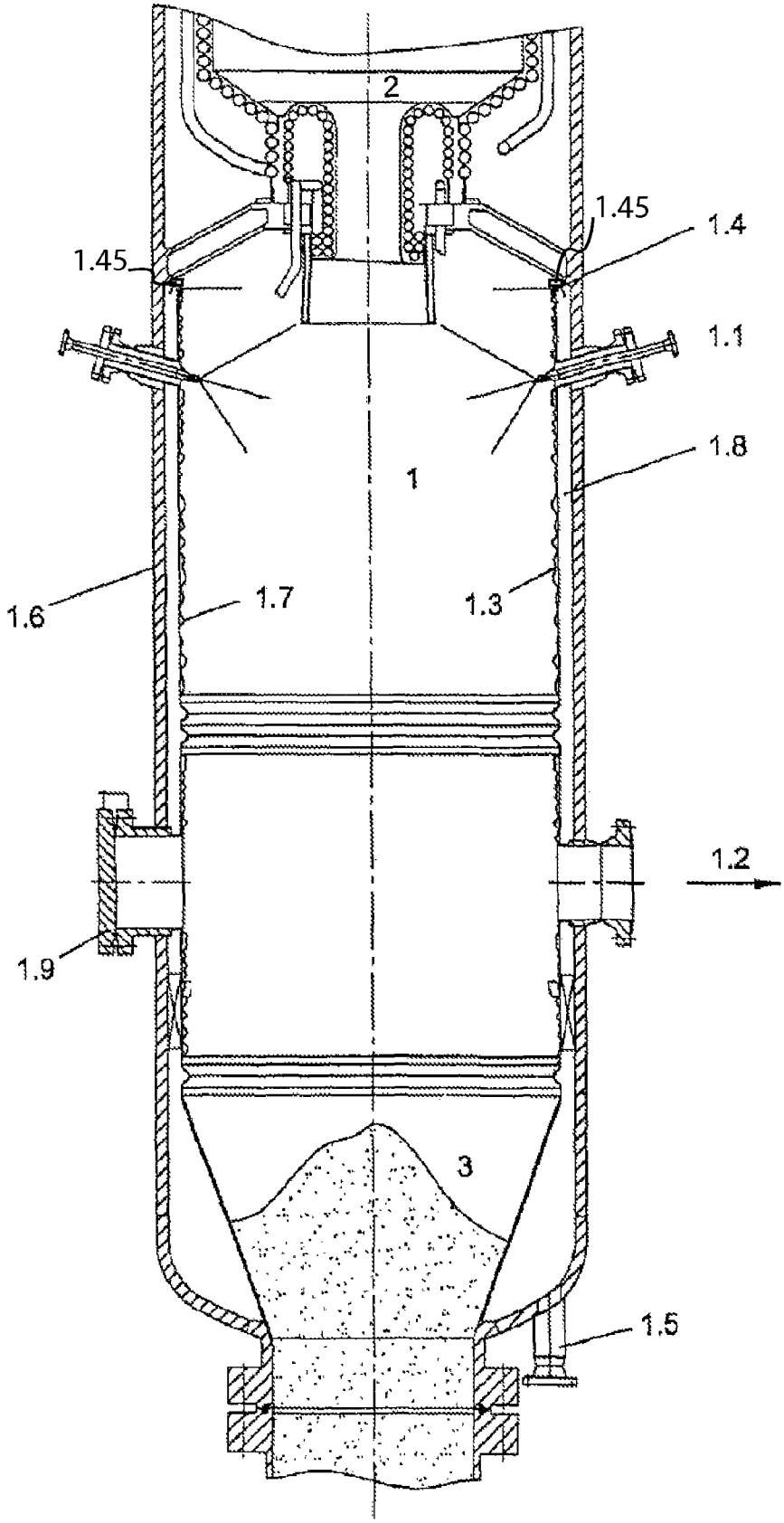
2
1.45
1.4
1.45
1.1
1.8
1
1.6
1.7
1.3
1.2
1.9
3
1.5

METHOD AND APPARATUS FOR COOLING HOT GASES AND FLUIDIZED SLAG IN ENTRAINED FLOW GASIFICATION

BACKGROUND OF THE INVENTION

1. Field of the Invention

The invention relates to a method and apparatus for cooling hot gases and fluidized slag in entrained flow gasification. The method is suited for a reactor for entrained flow gasification and for cooling the gasifying gas heated to a temperature ranging from 1,200 to 1,800° C., using pressures of up to 80 bar. The hot gasifying gas and the liquid slag exit these reactors together for entrained flow gasification of solid and liquid combustibles, and enter the cooling chamber, which is also often referred to as the quench chamber, with gasification being performed as an autothermal partial oxidation. The combustible may be pressurized as a carbon-water or carbon-oil suspension, a so-called slurry, or pneumatically as dry combustible dust and supplied to the reactor's head via burners for gasification. One or more combustibles or carbon types can be gasified.

2. The Prior Art

In gas production technique, the autothermal entrained flow gasification of solid, liquid and gaseous combustibles has been known for many years. For reasons of synthesis gas quality, the ratio of combustible to oxygen-containing gasification agents is chosen such that higher carbon compounds are completely cleaved into synthesis gas components such as CO and $H_2$ and the inorganic constituents are discharged in the form of a molten slag.

According to different systems well known in the art, gasifying gas and molten slag can be discharged separately or together from the reaction chamber of the gasification apparatus, as described for example in German Patent No. DE 197 18 131 A1.

German Patent No. DE 3534015 A1 shows a method in which the gasification fluids, small coal and oxygen-containing oxidizing agents are introduced into the reaction chamber via a plurality of burners in such a manner that the flames cause each other to deviate. Thereby, the gasifying gas flows upward, loaded with particulate matter, and the slag flows downward into a slag cooling system. Usually, an apparatus for indirect cooling using waste heat is provided above the gasification chamber. The entrained liquid slag particles however are likely to deposit and coat the heat exchanger surfaces, with the heat transfer being impaired and the tube system possibly becoming clogged or erosion occurring as a result thereof. The risk of clogging is countered by cooling the hot crude gas with a circulated cooling gas. The slag exits the gasifier and directly enters a waste heat vessel in which the crude gas and the slag are cooled for vapor generation, using waste heat. The slag accumulates in a water bath and the cooled crude gas exits the waste heat vessel sideways. The advantage of this waste heat production according to this system is offset by a series of disadvantages, in particular, the formation of deposits on the heat exchanger tubes, which impair heat transfer and lead to corrosion and erosion and, as a result thereof to a lack of availability.

SUMMARY OF THE INVENTION

It is therefore an object of the invention to provide a method and an apparatus for cooling the hot gasifying gas and the liquid slag without jeopardizing the pressure-carrying tank wall of the cooling chamber through overheating, with the apparatus being configured such that a pressure of up to 80 bar can be applied to the tank wall.

This object is accomplished by a method of cooling hot crude gas and slag from entrained flow gasification of liquid and solid combustibles at crude gas temperatures ranging from 1,200 to 1,800° C. and at pressures of up to 80 bar in a cooling chamber disposed downstream of the gasification reactor by injecting water. The cooling water introduced for cooling into the cooling chamber is distributed, with a portion being nozzled, finely dispersed, into a cooling chamber designed to be a free space, and another portion being fed at the bottom into an annular gap provided between the pressure-carrying tank wall and an incorporated metal apron for protecting the pressure-carrying tank wall. This portion of the cooling water flows upward in the annular gap and trickles down the inner side of the metal apron in the form of a water film.

Hot gas and liquid slag exit the reactor together and flow into the quench chamber in which they are cooled to equilibrium temperature by injecting water in excess through nozzles. The cooled, saturated crude gas is introduced through a side outlet to the next process portion, while the cooled and granulated slag accumulates in the water bath and is evacuated downward. Temperature measuring means are disposed at the crude gas outlet for controlling the gas temperature. The quench chamber is implemented such that a metal apron is incorporated into the pressure tank.

This metal apron is:

- solidly welded to the tank jacket at the granulate discharge port,
- is in gas-tight connection with the lateral gas outlet port, the manhole and the feed ports of the nozzle rows,
- configured to be a spill dam toward the top and breathable at the quench chamber,
- made from a solid material that is resistant to Cl ions and acid corrosion such as an austenitic steel alloy.

The nozzles for cooling combustible gas and slag are evenly spaced on the perimeter of the quench chamber. The amount of quench water supplied is designed to allow the gasifying gas and the slag to be cooled down by the injected water to a temperature ranging from 180 to 240° C. The quench water is supplied in excess so as to allow a water bath to form at the bottom of the quencher for the slag to drop into. The level of the water bath is set by a fill level control.

Part of the quench water flow is fed into the annular gap between the pressure tank wall and the metal apron at the bottom of the quench tank. In the annular gap, the water flows upward, thus protecting the jacket from thermal overload. The rising quench water is heated by the very good heat transfer, or heat loss in the quench chamber is minimized using pre-heated quench water. The water spilling over the dam flows into the water bath at the bottom, forming a water film on the inner jacket wall. On the height of the spillover dam, there is disposed a fill level measuring means for monitoring the water level in the annular gap. The supplied amount of quench water, the temperature of the crude gas exiting the quencher and the water fill level in the annular gap are all monitored by a master safety system.

The method and the apparatus according to the invention have the advantage of cooling crude gas heated to a temperature of 1,200-1,800° C. and exiting an entrained flow gasifier together with liquid slag without jeopardizing the pressure-carrying tank wall of the cooling chamber through overheating. This is achieved by incorporating a metal apron, with a portion of the cooling water being introduced into the thus formed annular gap. As a result, the pressure-carrying tank wall can absorb the cooling water temperature and is thus protected.

BRIEF DESCRIPTION OF THE DRAWINGS

Other objects and features of the present invention will become apparent from the following detailed description considered in connection with the accompanying drawing. It is to be understood, however, that the drawing is designed as an illustration only and not as a definition of the limits of the invention.

FIG. 1 shows an entrained flow gasification reactor for carrying out the method of the invention.

DETAILED DESCRIPTION OF THE PREFERRED EMBODIMENT

As shown in the drawing, a gasification reactor 2 with a gross output of 500 MW. 58 t/h of carbon dust are converted to crude gas and to liquid slag by adding an oxygen-containing gasifying agent and vapor by means of autothermal partial oxidation at an operating pressure of 41 bar. An amount of 145,000 $m^3$ N/h of produced, humid crude gas and 4.7 Mg/h of slag exit together the reactor 2 into the free space of the cooler 1. Through 12 nozzles 1.1 evenly spaced on the perimeter of the cooler 1, an amount of 220 $m^3$/h of cooling water is injected at a temperature of 178° C. Through the cooling process, the crude gas is cooled down to an equilibrium temperature of 220° C. and saturated according to the operating pressure. The 328,000 $m^3$ N/h of now cooled, saturated crude gas exits the cooler 1 through the lateral crude gas outlet 1.2. The slag drops into the water bath 3 at the cooler's bottom where the temperature shock causes the slag to vitrify and, as a result thereof, to solidify and form into granules. The slag is evacuated by means of a lock hopper. 15 m, 3/h of cooling water are fed into the annular gap between pressure tank wall 1.6 and the metal apron 1.3. The cooling water flows upward in annular chamber 1.8, enters cooling chamber 1 through the spillover dam 1.4 and runs down the inner wall of metal apron 1.3 in the form of a water film 1.7.

The cooling water utilized is gas condensate, partially purified wash or excess water, partially recirculated from downstream process stages and demineralised water for replenishing lost water or a mixture thereof, with the pH being adjusted between 6 and 8. This adjustment is made by adding an acid or alkaline substances. There is also a fill level measuring means 1.45 for controlling the operability of the metal apron 1.3, this fill level measuring means 1.45 being disposed on the metal apron 1.3 at a height of the spillover dam 1.4.

Accordingly, while only a few embodiments of the present invention have been shown and described, it is obvious that many changes and modifications may be made thereunto without departing from the spirit and scope of the invention.

LIST OF THE REFERENCE NUMERALS USED

1 cooler
1.1 nozzles
1.2 crude gas outlet
1.3 metal apron
1.4 spillover dam
1.5 port
1.6 pressure tank wall
1.7 water film
1.8 annular chamber
1.9 port
2 reactor
3 water bath

What is claimed is:

1. A method of cooling hot crude gas and slag from entrained flow gasification of liquid and solid combustibles at crude gas temperatures ranging from 1,200 to 1,800 degrees C. and at pressures of up to 80 bar, the method comprising:

providing an entrained flow gasification reactor having a cooling chamber configured to be a free space disposed downstream;

providing a metal apron forming an annular channel with a cooling chamber wall, said apron protecting said pressure-carrying cooling chamber wall;

providing nozzles in said apron for dispersing cooling water in a free space of said cooling chamber;

feeding a first portion of cooling water through a nozzle of said nozzles into the cooling chamber so as to be finely dispersed; and feeding a second portion of cooling water into a bottom of said annular channel, so that said second portion of the cooling water flows upward in said annular channel;

spilling said second portion of said cooling water over a top of said metal apron wherein the top of said metal apron forming a spillover dam, so that said second portion of cooling water trickles down an inner side of said metal apron in a form of a water film completely coating the inner side of said metal apron;

monitoring a height of water spilling over the spillover dam so that the operability of said metal apron is monitored and so that the metal apron can be cooled by the cooling water and thus be protected; and cooling down the crude gas by injecting water down to vapor saturation at temperatures between 180 degrees C. and 240 degrees C.

2. The method as set forth in claim 1, wherein the cooling water used is selected from the group consisting of gas condensate, partially purified wash, excess water partially recirculated from downstream process stages, demineralised water for replenishing lost water, and mixtures thereof, with a pH of between 6 and 8.

3. The method as set forth in claim 1, wherein the pH of the cooling water is controlled.

4. The method as in claim 1, wherein said step of monitoring an operability of said metal apron comprises monitoring a water level in said annular gap.

5. The method as in claim 1, wherein said step of monitoring an operability of said metal apron comprises monitoring a supplied amount of quench water.

6. The method as in claim 1, further comprising the step of monitoring a temperature of a crude gas exiting said quencher.

7. The method as in claim 1, wherein said step of monitoring an operability of said metal apron comprises monitoring a water fill level in said annular gap.

8. A method for cooling hot crude gas and slag from entrained flow gasification of liquid and solid combustibles at crude gas temperatures ranging from 1,200 to 1,800 degrees C. and at pressures of up to 80 bar, comprising:

providing an entrained flow gasification reactor having a cooling chamber with a pressure jacket;

providing a metal apron incorporated into the cooling chamber, so that an annular space is formed between the pressure jacket and the metal apron wherein said metal apron forms an annular channel with said cooling chamber wall;

providing nozzles in said apron for dispersing a first portion of cooling water in the center of said apron;

supplying said first portion of cooling water through a nozzle of said nozzles;

supplying a second portion of cooling water to a bottom portion of the annular channel the second portion of cooling water flowing upward through said annular channel;

spilling said second portion of cooling water over a top of the apron which forms a spillover dam, trickling down the second portion of cooling water along the inner side of the metal apron in the form of a closed water film;

monitoring the operability of the metal apron, by using a fill level measuring means being disposed on the metal apron at a height of the spillover dam-by monitoring an amount of water allowed to spill over the spillover dam such that the metal apron can be cooled by the cooling water and be protected; and cooling down the crude gas by injecting water down to vapor saturation at temperatures between 180 degrees C. and 240 degrees C.

9. The method as set forth in claim 8, wherein the metal apron is welded in gastight connection with ports mounted to the pressure carrying tank wall.

10. The method as set forth in claim 8, wherein the metal apron is made from a material that is resistant to Cl ions and acid corrosion.

11. The method as in claim 8, wherein said step of monitoring an operability of said metal apron comprises monitoring a water level in said annular gap.

12. The method as in claim 8, wherein said step of monitoring an operability of said metal apron comprises monitoring a supplied amount of quench water.

13. The method as in claim 8, further comprising the step of monitoring a temperature of a crude gas exiting said quencher.

14. The method as in claim 8, wherein said step monitoring an operability of said metal apron comprises monitoring a water fill level in said annular gap.

15. A method for cooling hot crude gas and slag from entrained flow gasification of liquid and solid combustibles at crude gas temperatures ranging from 1,200 to 1,800 degrees C. and at pressures of up to 80 bar, comprising:

providing an entrained flow gasification reactor having a cooling chamber with a pressure jacket;

providing a metal apron incorporated into the cooling chamber, so that an annular space is formed between the pressure jacket and the metal apron wherein said metal apron forms an annular channel with said pressure jacket;

providing nozzles in said metal apron for dispersing a first portion of cooling water in the center of said metal apron;

supplying said first portion of cooling water through a nozzle of said nozzles;

supplying a second portion of cooling water to a bottom portion of the annular channel the second portion of cooling water flowing upward through said annular channel;

spilling said second portion of cooling water over a top of the apron which forms a spillover dam, trickling down the second portion of cooling water along the inner side of the metal apron in the form of a closed water film;

using a fill level measuring means being disposed on the metal apron at a height of the spillover dam to monitor a water level in said annular gap, said water allowed to spill over the spillover dam such that the metal apron can be cooled by the cooling water and is thus protected;

cooling down the crude gas by injecting water down to vapor saturation at temperatures between 180 degrees C. and 240 degrees C.;

monitoring a temperature of a crude gas exiting the cooling chamber.

* * * * *